United States Patent [19]

Phillips et al.

[11] Patent Number: 4,524,953

[45] Date of Patent: Jun. 25, 1985

[54] ADJUSTABLE PROTECTIVE ROPE BARRIER

[76] Inventors: Roger W. Phillips; Ann L. Phillips, both of 8030 E. Township Rd. 88, Bloomville, Ohio 44818

[21] Appl. No.: 370,874

[22] Filed: Apr. 22, 1982

Related U.S. Application Data

[63] Continuation-in-part of Ser. No. 304,771, Jul. 23, 1981, abandoned.

[51] Int. Cl.[3] ..... A01G 17/06

[52] U.S. Cl. ..... 256/23; 256/1; 49/34

[58] Field of Search ..... 49/34; 256/1, 23

[56] References Cited

U.S. PATENT DOCUMENTS

| | | | |
|---|---|---|---|
| 2,034,493 | 3/1936 | Sonnenberg | 293/41 |
| 2,480,509 | 8/1949 | Ripley . | |
| 2,508,757 | 5/1950 | Gray . | |
| 2,571,362 | 10/1951 | Hervey . | |
| 3,782,766 | 1/1974 | Teel . | |
| 3,812,978 | 5/1974 | Roland et al. | 256/1 X |
| 4,051,953 | 10/1977 | Shoaf . | |
| 4,154,254 | 5/1979 | Spencer . | |
| 4,164,233 | 8/1979 | McAndrew . | |

*Primary Examiner*—Andrew V. Kundrat
*Attorney, Agent, or Firm*—Dowell & Dowell

[57] ABSTRACT

A protective crowd control barrier for maintaining observers in spaced relationship to an article being displayed such as an automobile or the like in which the barrier includes a plurality of adjustable uprights which receive a flexible barrier member in a manner such that the flexible member is spaced from and extends entirely around the article. The uprights are selectively adjustable to alter the elevation as well as the spacing of the barrier member from the article being displayed.

15 Claims, 13 Drawing Figures

Fig. 4
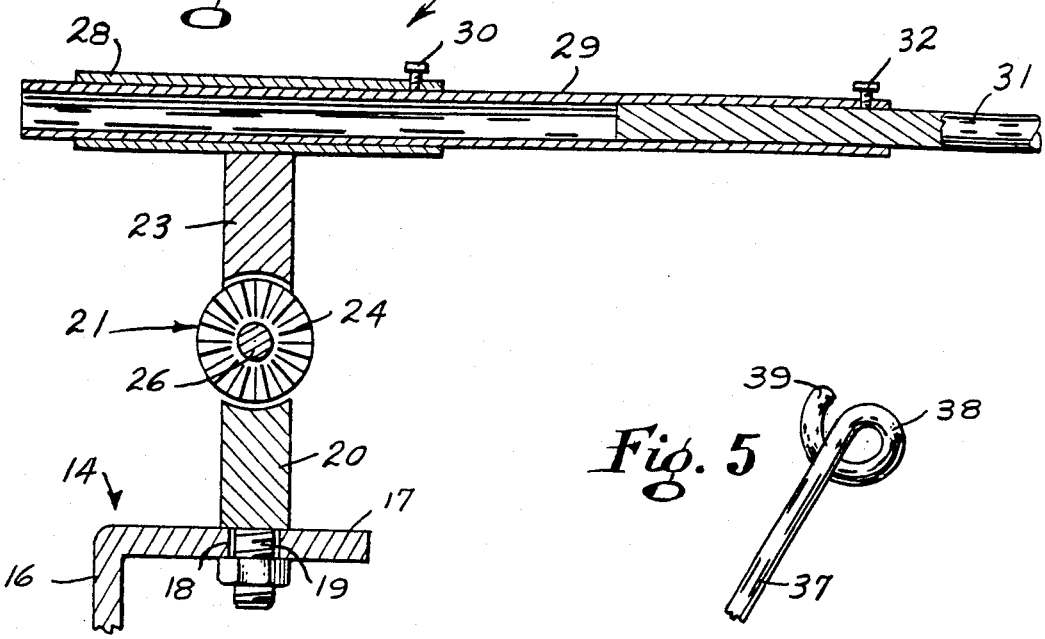
Fig. 5
Fig. 6
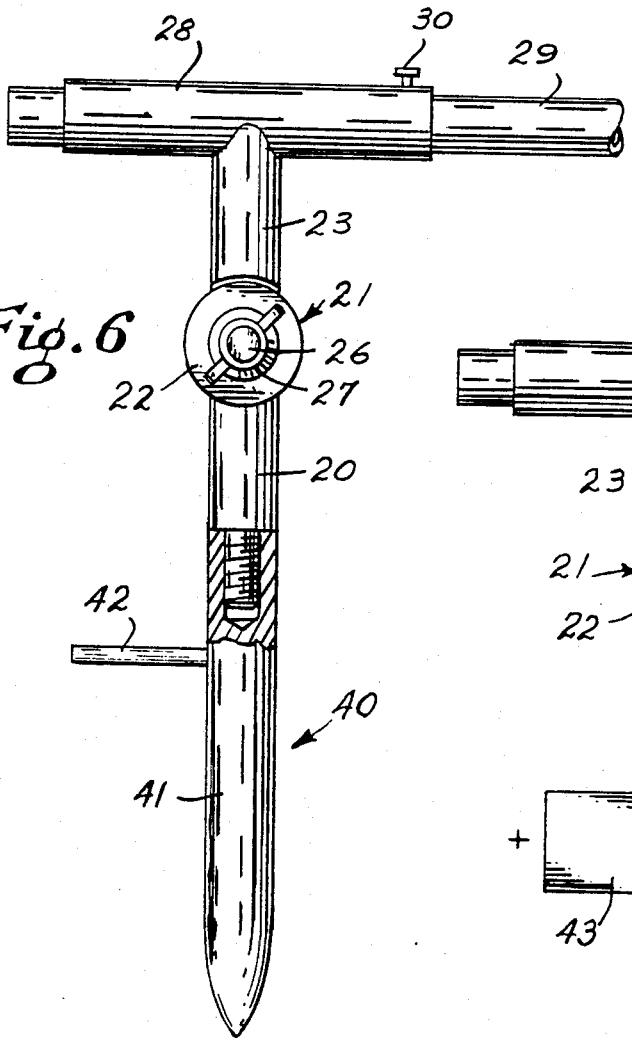
Fig. 7
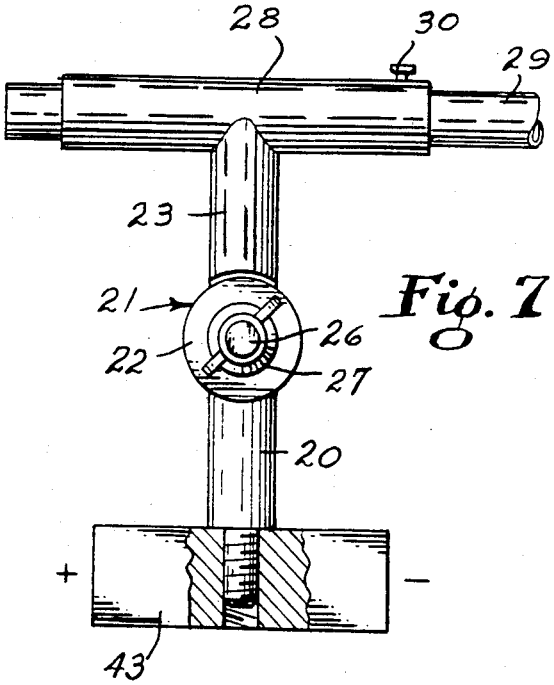

Fig. 8
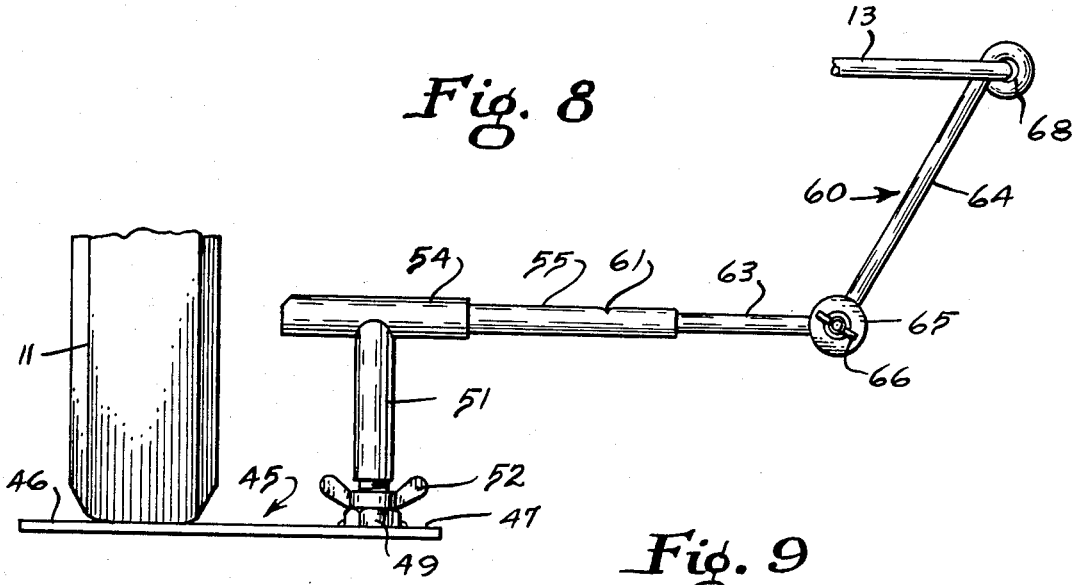
Fig. 9
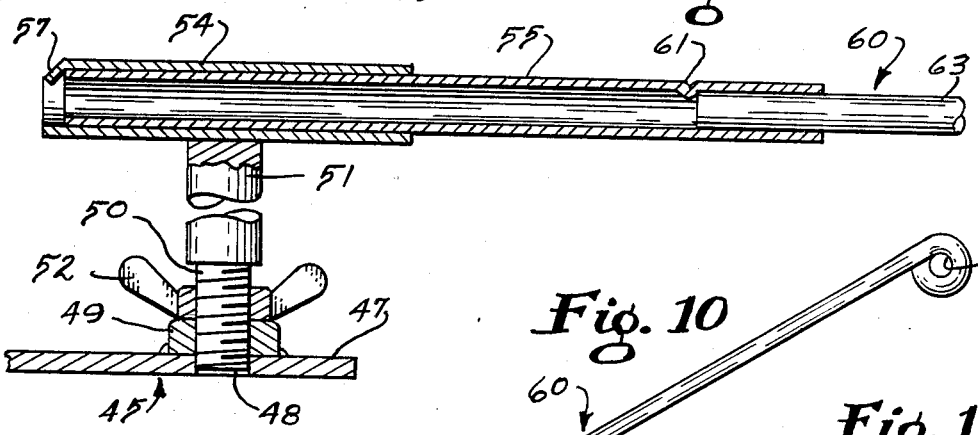
Fig. 10
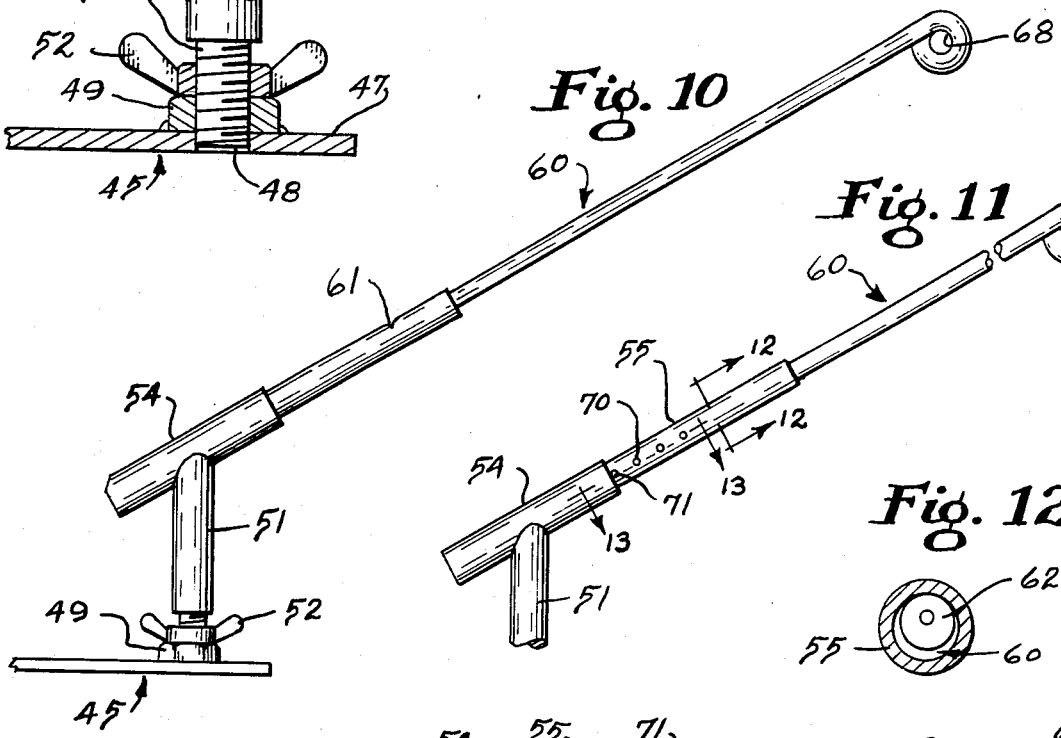
Fig. 11
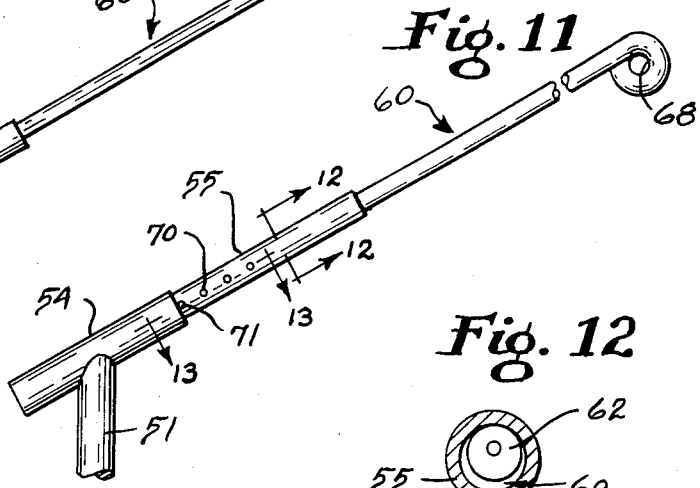
Fig. 12
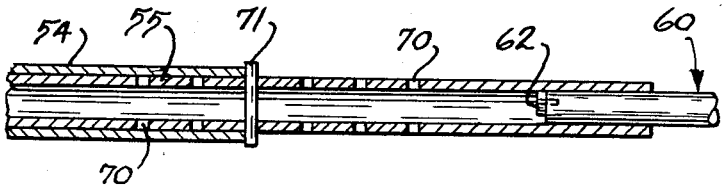
Fig. 13

ADJUSTABLE PROTECTIVE ROPE BARRIER

CROSS-REFERENCE TO RELATED INVENTIONS

This application is a continuation-in-part of applicant's prior application Ser. No. 304,771, filed Sept. 23, 1981, entitled ADJUSTABLE PROTECTION ROPE BARRIER, now abandoned.

TECHNICAL FIELD

This invention relates to protective barriers of various kinds including barriers having a flexible barrier member such as a rope or the like which is positioned around an article which spectators may wish to observe in order to discourage the spectators from coming into contact with the article itself.

BACKGROUND ART

In the past, articles which are on display such as antique automobiles or the like have generated considerable interest from the public, particularly when the automobiles have been placed on display such as at a public showing. In the absence of a barrier around a display article such as a vehicle, spectators often contact the vehicle and, in some cases, enter the vehicle for closer inspection. Unfortunately even the most innocent and well meaning of observers can cause inadvertent damage to the display vehicle or other article. Frequently, items carried on a spectator's person such as a belt buckle, ring or the like or an object carried by the spectator, such as a lady's purse, scratch or otherwise mar the finish of the display article causing substantially repair expenses to the owner.

Some efforts have been made to reduce spectator damage by placing barriers about the article being displayed, some of these barriers have been designed to include upright standards which are placed around and in spaced relationship to the article. Ropes or the like are then attached to the standards. Normally, such standards are provided with a relatively large heavy base which is used to steady the standards when they are used on hard surfaces such as concrete, asphalt paving or the like; additionally such standards may have an eye or ring at the upper end for receiving a barrier member such a rope. When an article such as an automobile is being displayed on a grass plot or dirt, the upright posts or standards may include spikes which can be driven into the earth. Such upright standards, particularly those having heavy base members, normally are cumbersome and unwieldy and are difficult to transport from place to place, further such free standing standards are subject to being upset or knocked down thereby possibly causing damage to the display article.

Some efforts have been made to alleviate the problems associated with displaying articles such as antique automobiles as for example in U.S. Pat. No. 3,782,766 to Teel in which a plurality of nonadjustable upright members have been provided. With this structure the lower ends of the upright members are clamped directly to the vehicle, such as to the bumpers or the like and the upper ends of the upright members are provided with eyes through which a rope may be passed. As this type of structure is not adjustable as to height or spacing from the automobile, the resultant placement of the rope barrier will vary depending upon the type and size of the article to which it is attached. Additionally, any stress impartial to the barrier member by spectators will be conveyed directly to the part of the vehicle to which the standards are clamped and may cause damage thereto.

Other examples of structures which provide protective coverings for vehicles and the like include the U.S. Pat. Nos. 2,034,493 to Sonnenberg; 2,480,509 Ripley; 2,508,757 Gray; 2,571,362 Hervey, 4,154,254 Spencer; and 4,164,233 McAndrew.

DISCLOSURE OF THE INVENTION

The present invention is embodied in an adjustable protective rope barrier and includes a barrier support standard having a base to which an upright post is attached. In one embodiment of the invention, the upright post includes at least one adjustable element intermediate its ends so that the upper and lower portions of the post may be positioned out of axial alignment with each other. The upper end of the post is fixed to a generally horizontally oriented sleeve which slidable receives one or more telescoping members which may be fixed or retained in selected adjusted position within the sleeve. In some embodiments of the invention the outer end of the telescoping members may be adjustably connected to an upright rod or the like which is provided with means for receiving and supporting a portion of a flexible member such as a rope or the like.

It is an object of the invention to provide an adjustable collapsible rope barrier apparatus including a base member which may rest on the ground and may be anchored by the weight of the vehicle in a manner such that damage to the vehicle does not occur and that accidental displacement of the barrier is prevented.

It is another object of the invention to provide an adjustable rope barrier in which the vertical and/or horizontal orientation of the rope may be selectively accomplished by adjustment to one or more upright post and horizontal slide members.

It is a further object of this invention to provide an adjustable crowd control barrier which may be constructed so as to be light in weight and easily disassembled for storage.

DESCRIPTION OF THE DRAWINGS

FIG. 4 is a sectional view taken on the line 4—4 of FIG. 3.

FIG. 5 is a fragmentary perspective view of the upper end of the rope engaging rod.

FIG. 6 is an enlarged fragmentary side elevational view similar to FIG. 2 illustrating another embodiment.

FIG. 7 is an enlarged fragmentary side elevational view similar to FIG. 2 illustrating a further embodiment.

FIG. 8 is a side view elevational view illustrating another embodiment of the invention.

FIG. 9 is an enlarged fragmentary cross-sectional view of the embodiment of FIG. 8.

FIG. 10 is a side elevational view illustrating another embodiment of the invention.

FIG. 11 is a fragmented side elevational view illustrating another embodiment of the invention in which alternative locking and/or adjusting features are disclosed.

FIG. 12 is an enlarged section taken along lines 12—12 of FIG. 11.

FIG. 13 is an enlarged section taken along lines 13—13 of FIG. 11.

BEST MODE FOR CARRYING OUT THE INVENTION

Figure 1:
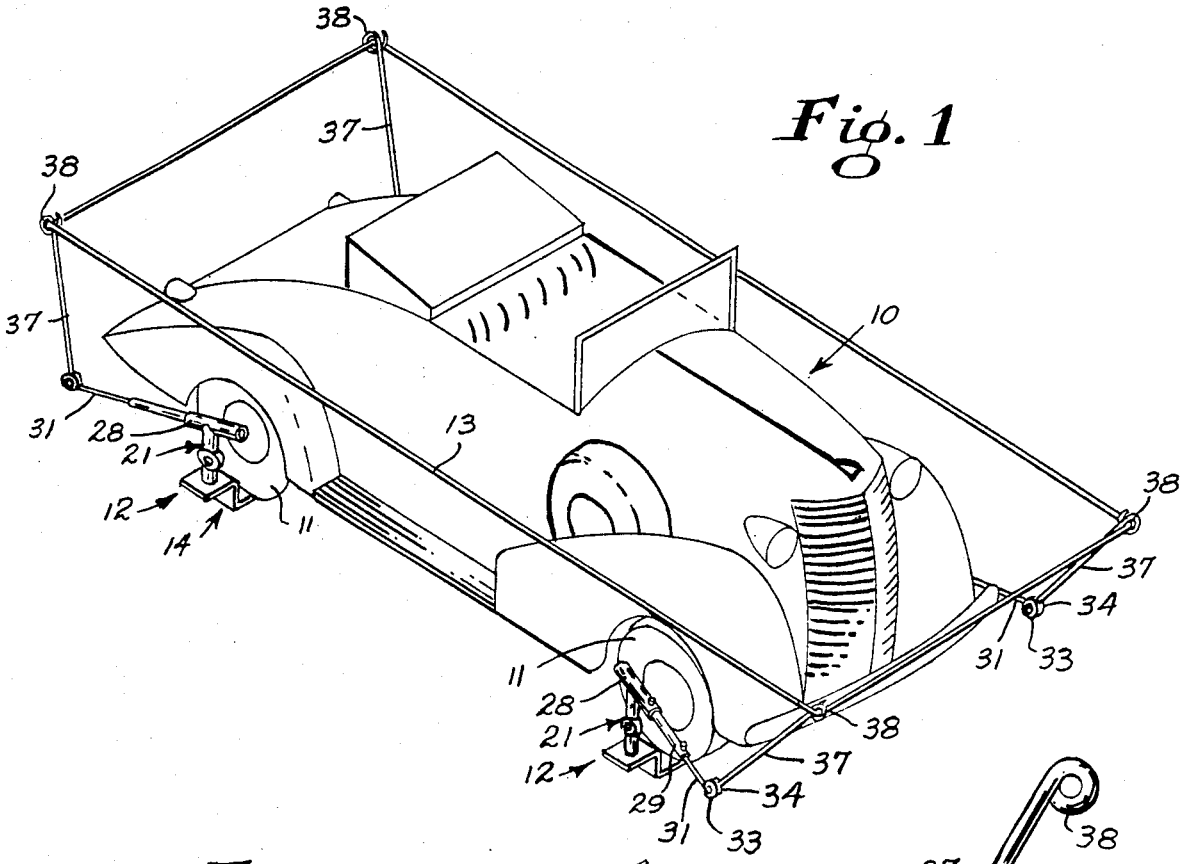
FIG. 1 is a perspective view illustrating one application of the invention.
Figure 2:
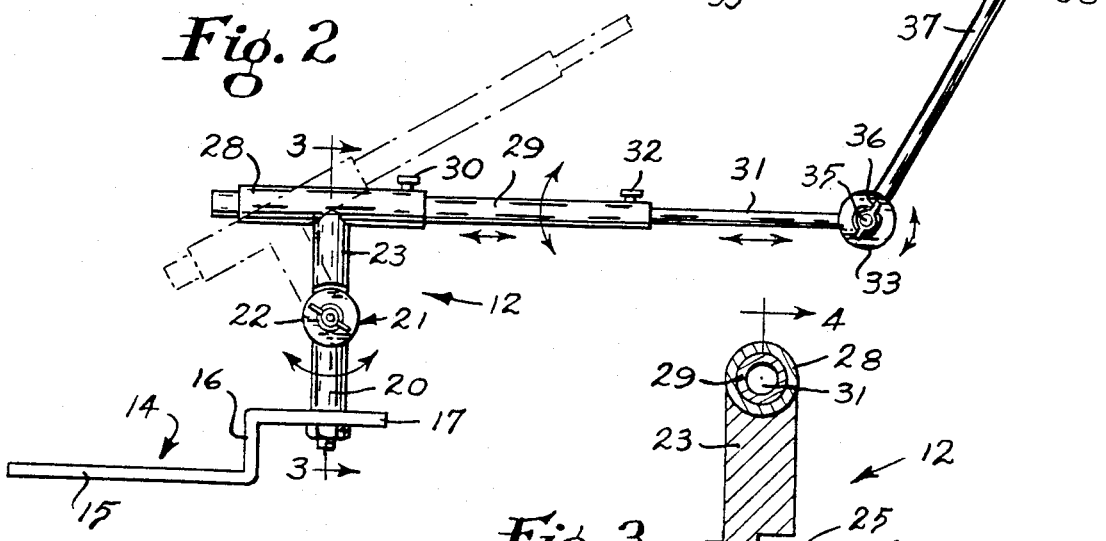
FIG. 2 is a side elevational view illustrating one embodiment of the adjustable barrier support per se.

With continued reference to the drawings, the present invention will be described in association with an article to be displayed and particularly in association with an automobile 10 which may be an antique automobile or a new experimental automobile having ground engaging wheels 11. In order to permit spectators to observe the vehicle without physically contacting the same, a plurality of barrier standards 12 are provided which support a rope or other elongated member 13 in spaced relationship to the automobile. Preferably, the number of barrier standards used is sufficient to permit the rope 13 to extend entirely around the automobile so that the automobile is completely protected.

With particular reference to FIGS. 1–5, the barrier support includes a base 14 having upper and lower offset plate members 15 and 17 which are integrally connected by a vertically oriented web 16. The base is thus substantially of a Z-shaped configuration. The lower plate member 15 of the base 14 is of a size such that when the base is placed on the ground or other supporting surface, such plate member can be engaged by the vehicle wheels 11.

The upper plate 17 is provided with an opening 18 which receives the lower reduced threaded end 19 of the lower portion 20 of an articulated post 21. The post 21 is locked to the plate 17 in any desired manner as by a nut or other fastener. The upper end of the lower portion 20 is integrally connected to a generally circular enlargement or boss 22 having a multiplicity of generally radial teeth or projections. An upper portion 23 of the articulated post 21 has an enlargement or boss 24 at the lower end and such enlargement has a multiplicity of radially disposed teeth or depressions which cooperatively receive the teeth or projections of the enlargement 22. In this manner the enlargements may be adjusted relative to each other so that the upper and lower portions 20 and 23 of the post 21 may be arranged generally coaxially with each other or may be disposed at an angle relative to each other. In order to lock the upper and lower portions of the post 21 in fixed adjusted position, one of the enlargements 22 or 24 is provided with a central opening 25 and the other enlargement has a threaded stud 26 which extends through the opening 25 and is provided with a wing nut 27 or the like for securing the enlargements 22 and 24 in fixed adjusted position.

The upper end of the upper portion 23 of the post 21 is welded or otherwise attached to a sleeve 28 located generally normal to the axis of such post. The sleeve serves to support one or more laterally extending and adjustable support members. In the embodiment of FIGS. 1–7, an elongated laterally extending tube 29 is slidably received within the sleeve 28 and is secured in fixed adjusted positon by a set screw 30 carried by the sleeve 28.

An elongated laterally extending rod 31 is telescopically received within the elongated tube 29 and is fixed in adjusted positon by a set screw 32 carried by the elongated tube 29. It will be apparent that the tube 29 may be extended and retracted relative to the sleeve 28 and may be rotated about its axis within such sleeve. It is also apparent that the rod 31 may be extended and retracted relative to the elongated tube and also may be rotated about its axis.

The outer end of the rod 31 is welded or otherwise attached to an enlargement or boss 33 having a plurality of generally radial teeth or projections (not shown) on the inner surface which cooperatively receive the teeth or depressions of a second and opposing enlargement or boss 34 and is attached thereto by a stud 35 and wing nut 36. One end of a rod member 37 is welded or otherwise attached to the enlargement 34 and the other end of such rod member is provided with a rope receiving eye 38. Preferably, the rope receiving eye is formed by bending the upper end of the rod 37 substantially into a circle with the terminal end 39 of the eye being spaced from the body of the rod by at least the thickness of the rope 13 (FIG. 5). This construction is preferred so that the rope may be inserted into the eye merely by passing portions of the rope between the body of the rod and the terminal end without the necessity of weaving the rope through a closed eye. It will be obvious that the rod 37 may be positioned generally axially of the rod 31 or may be disposed at an angle thereto as illustrated best in FIGS. 1 and 2.

If desired, the upper end of the rod 37 may be connected to a closed eye, ring, hook, sister hooks or the like which partially or entirely surround a portion of the rope 13 to maintain the rope adjacent to the upper end of the rod 37.

With particular reference to FIG. 6, the barrier standard may be provided with a base 40 which will be used when the automobile is being displayed on grass or dirt, such base includes an elongated spike 41 having an opening at its upper end which threadedly receives the reduced lower end 19 of the lower portion of the post 21. To assist in driving the spike 41 into the ground, a foot plate or bar 42 is welded or otherwise attached to the spike 41 and is adapted to be engaged by the foot of a person so that the person may use his or her weight to force the spike into the ground. The remaining portions of the barrier support are substantially the same as previously described.

With particular reference to FIG. 7, a base 43 is provided which is threadedly attached to the lower end 19 of the lower portion of the post 21 and such base preferably is a permanent magnet which can easily be attached by magnetic attraction to any ferrous material such as the frame of the automobile or to the web 16 of the base 14 without causing damage to the automobile or the base.

In the operation of the device, four barrier supports, one for each corner, are provided for each automobile and such barrier supports may be easily disassembled and carried in the trunk or other portion of the automobile which is to be displayed and can be quickly and easily assembled and erected when the automobile reaches the display area. If the site is in a showroom or other exhibit hall having a hard floor, the base 14 is selected and one of such bases is positioned adjacent to each wheel of the vehicle. Thereafter, the vehicle is moved a short distance to cause the wheels to roll onto the flat plates 15 thereby securing the bases in fixed position. A lower post 20 is fixed to the outwardly extending plate 17 of each base and such posts are rotated about a vertical axis so that the sleeves 28 are disposed at any desired angle relative to the vehicle. Also, the enlargements 22 and 24 are adjusted relative to each other so that the sleeves 28 either are generally horizontal with the floor or are disposed at an angle thereto. An elongated tube 29 is inserted into each of the sleeves 28 and a rod 31 is inserted into the tube 29. Each of the rods and tubes are moved to a selected position and then secured. Thereafter, an upper rod 37 is connected to each of the rods 31 by means of the enlargements 33 and 34 so that the eyes 38 are positioned at a desired elevation.

After the barrier supports 12 are positioned relative to the automobile, the rope 13 is attached to the eyes 38 by passing a portion of the rope between the body of the rods 37 and the terminal end 39 so that the rope is received within the eyes 38. With this construction, the ends of the rope may be spliced together to form an endless loop so that unsightly knots are avoided.

If the display area is located on grass or other surfaces which may be penetrated, the operator may select the spike base 41 which may be easily driven into the ground or the like.

It is apparent that, if desired, the base 43 may be selected which may be magnetically attached to a portion of the vehicle itself or may be used in cooperation with the base 14 according to the discretion of the operator.

With respect to FIGS. 8–11 several alternate embodiments of the invention are disclosed. In FIG. 8 the barrier standard includes a generally planar base plate 45. The base plate 45 is of an elongated rectangular construction having an end 46 which is engageable by the wheels 11 of a vehicle. The other end 47 of the base extends remotely from the vehicle and has an opening 48 therethrough. A nut 49 is welded in alignment with the opening 48 and threadingly receives the reduced and threaded end portion 50 of a vertical post 51. The post 51 is locked in place to the base 45 after the reduced end portion has been threaded into the nut 49 by means of a jam nut 52.

An elongated open sleeve member 54 is fixedly secured to the upper portion of the vertical post 51 and serves to support one or more laterally extending and adjustable support members. In the embodiment of FIGS. 8–13, the sleeve member 54 receives an elongated laterally oriented and slidably adjustable tube member 55. The sleeve 54 may be either horizontally oriented as shown in FIGS. 8 and 9 or may be angularly oriented between a vertical and horizontal plane as shown in FIGS. 10 and 11. In either embodiment, the inner end 56 of the sleeve (that end which is disposed toward end 46 of the base plate 45) may include a crimped portion 57 which will prohibit movement of the tube 55 through the sleeve 54.

A laterally extending rod member 60 is adjustably carried within the tube 55. As shown in FIG. 9, the tube 55 may include a crimped wall portion 61 which serves to limit the inward movement of the rod 60 within the tube 55. In this embodiment, the rod may be maintained in a selectively adjusted position by friction fitting the rod within the tube as shown in FIG. 9 or a locking offset cam 62 may be secured to the innermost end of the rod as shown in FIGS. 12 and 13. When the locking cam is used, the rod need only be rotated to force the cam from engagement with the inner surface of the tube 55 and thereafter the rod adjusted axially. Once the rod has been adjusted to a selected position, the rod is again rotated until the cam 62 engages and binds the rod against the inner surface of the tube as shown in FIG. 12.

Figure 3:
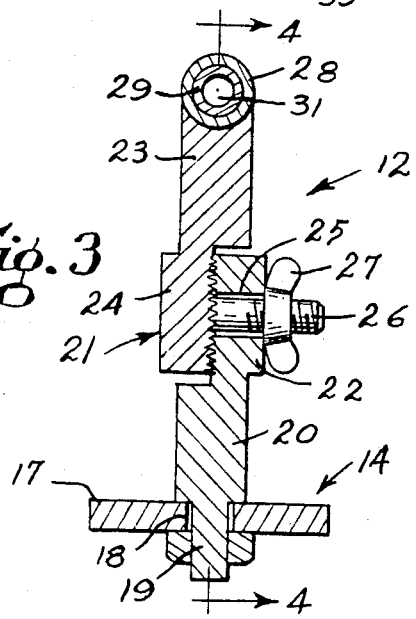
FIG. 3 is a sectional view to an enlarged scale taken along the line 3—3 of FIG. 2.

As shown in FIG. 8, the rod 60 may be articulated having inner and outer members 63 and 64 connected by a locking joint member 65 which is similar in construction to that shown in FIG. 3.

The joint member 65 permits the outer end 64 of the rod to be vertically adjusted relative to the inner end 63 thereof. A wing nut 66 is provided to lock the ends of the rod 60 in a selectively adjusted position.

The outermost end 68 of the rod 60 is formed into an open loop as previously described with respect to FIGS. 1–7 for selectively permitting the reception of a rope 13 or similar member therein.

As shown in FIGS. 10 and 11, the rod 60 may be of a single piece construction having no articulated joint intermediate its length. When the rod 60 is not itself adjustable in a vertical plane, the sleeve member 54 should be at least partially vertically oriented as shown in FIGS. 10 and 11 so that the resultant height of the barrier 13 may be adjusted simply by telescoping the rod 60 within the tube 55 and the tube 55 within the sleeve member 54.

As previously discussed, the tube 55 is selectively telescopically adjustable within the sleeve member 54. Such members may be held in adjusted position by friction fitting the tube within the sleeve, by set screws, as previously discussed with respect to FIGS. 1–7, or by providing a plurality of spaced and aligned openings 70 through the tube 55 through which a locking pin 71 may be selectively inserted to restrict further adjustment of the tube with respect to the sleeve.

We claim:

1. An adjustable protective barrier standard for use in supporting a portion of an elongated barrier member which fences off an article to be displayed comprising a base member, post means mounted on and extending generally vertically to said base member, said post means including first and second portions, joint means vertically spaced from said base member adjustably connecting said first and second portions, locking means associated with said joint means for securing said first and second portions of said post means in angularly adjustable position, said first portion of said post means being attached to said base member and extending to said joint means, said second portion of said post means having first and second ends, said first end being connected to said joint means, sleeve means fixed to said second end of said second portion of said post means in a manner such that the axis of the sleeve means is generally disposed in angular relationship ot the axis of said post means, at least one laterally extending elongated support means supported by said sleeve means and being axially adjustable outwardly relative thereto while being continuously supported thereby and retainer means for receiving and supporting a portion of the elongated barrier member carried by said elongated support member so that said barrier member is maintained in spaced relationship with the article being displayed.

2. The barrier standard of claim 1 in which said base member includes a first generally planer portion engageable by the article being displayed and a second portion horizontally spaced therefrom and means associated with said second portion of said base member for selectively mounting said first portion of said post means thereto.

3. The barrier standard of claim 1 in which said laterally extending support means includes a tube means slidably adjustable along said sleeve means and extending outwardly therefrom, and an elongated rod member slidably carried within said tube means and being axially adjustable relative thereto.

4. The barrier standard of claim 3 in which said elongated rod member includes first and second end portions, said first end portion of said rod member being slidably received within said tube means, said retainer means being attached to said second end portion of said rod member, joint means connecting said first and second portions of said elongated rod member so that said second portion may be vertically adjustable with respect to said first portion thereof.

5. The barrier standard of claim 4 including first securing means for selectively securing said elongated rod members to said tube means and second securing means for selectively securing said tube means to said sleeve means.

6. The barrier standard of claim 1 in which said base member includes an elongated spike means for driving into the earth said spike means having upper and lower portions, said upper portion of spike means having a recess therein for selectively receiving said first portion of said post means.

7. The support means of claim 1 in which said base member includes a magnet which is magnetically attracted to a portion of the article being displayed.

8. An adjustable protective barrier standard for use in supporting a portion of an elongated barrier member which fences off an article to be displayed comprising a base member, post means having upper and lower ends mounted on and extending generally vertically to said base member, said base member including a first generally planar portion engageable by the article being displayed and a second portion offset laterally and spaced therefrom and means associated with said second portion of said base member for selectively mounting said lower end of said post means thereto, sleeve means fixed to said upper end of said post means in a manner such that the axis of the sleeve means is generally disposed in angular relationship to the axis of said post means, at least one laterally extending elongated support member supported by said sleeve means and being axially adjustable outwardly relative thereto while being continuously supported thereby, means for restricting the movement of said elongated member relative to said sleeve member, and retainer means for receiving and supporting a portion of the elongated barrier member carried by said elongated support member so that said barrier member is maintained in spaced relationship with the article being displayed.

9. The barrier standard of claim 8 in which said sleeve means is generaly perpendicular oriented with respect to said upper end of said post.

10. The barrier standard of claim 8 in which said laterally extending support member includes a tube means slideably adjustable along said sleeve means and extending outwardly therefrom, and an elongated rod member slideably carried within said tube means and being axially adjustable relative thereto.

11. The barrier standard of claim 10 in which said elongated rod member includes first and second end portions, said first end portion of said rod member being slideably received within said tube means, said retainer means being attached to said second end portion of said rod member, joint means connecting said first and second portions of said rod member so that said second portion may be vertically adjustable with respect to said first portion thereof, and first securing means for selectively securing said rod member to said tube means and second securing means for selectively securing said tube means to said sleeve means.

12. An adjustable protective barrier standard for use in supporting a portion of an elongated barrier member which fences off an article to be displayed comprising a base member, post means having upper and lower ends mounted on and extending generally vertically to said base member, said lower end of said post means being attached to said base member, sleeve means fixed to said upper end of said post means in a manner such that the axis of the sleeve means is generally disposed in angular relationship to the axis of said post means, at least one laterally extending tube means supported by said sleeve means and being axially adjustable outwardly relative thereto while being continuously supported thereby, an elongated rod member slideably carried within said tube means and being axially adjustable relative thereto, said elongated rod member having first and second end portions, said first end portion of said rod member being slideably received within said tube means, joint means connecting said first and second portions of said rod member so that said second portion may be vertically adjustable with respect to said first portion thereof, and retainer means for receiving and supporting a portion of the elongated barrier member carried by said second end portion of said rod member so that said barrier member is maintained in spaced relationship with the article being displayed.

13. The barrier standard of claim 12 in which said post means includes first and second portions, joint means adjustably connecting said first and second portions, locking means associated with said joint means for securing said first and second portions of said post means in adjusted position, said first portion of said post means being attached to said base member and said sleeve means being attached to said second portion of said post means.

14. The barrier standard of claim 12 in which said base member includes a first generally planer portion engageable by the article being displayed and a second portion laterally spaced therefrom and means associated with said second portion of said base member for selectively mounting said lower end of said post means thereto.

15. The barrier standard of claim 12 including first securing means for selectively securing said elongated rod member to said tube means and second securing means for selectively securing said tube means to said sleeve means.

* * * * *